US006616231B2

(12) United States Patent
Koepke et al.

(10) Patent No.: US 6,616,231 B2
(45) Date of Patent: Sep. 9, 2003

(54) MULTI-POSITION TILT-LIMITING MECHANISM

(75) Inventors: Marcus C. Koepke, Indianapolis, IN (US); Jay R. Machael, Muscatine, IA (US); Brian R. Trego, Muscatine, IA (US)

(73) Assignee: Hon Technology Inc., Muscatine, IA (US)

( * ) Notice: Subject to any disclaimer, the term of this patent is extended or adjusted under 35 U.S.C. 154(b) by 0 days.

(21) Appl. No.: 09/882,500

(22) Filed: Jun. 15, 2001

(65) Prior Publication Data

US 2002/0190557 A1 Dec. 19, 2002

(51) Int. Cl.[7] ..... A47C 1/02

(52) U.S. Cl. ..... 297/313; 297/301.7; 297/300.7; 297/300.8; 297/319

(58) Field of Search ..... 297/301.7, 300.7, 297/300.8, 302.6, 30.2, 7, 313, 320, 319

(56) References Cited

U.S. PATENT DOCUMENTS

| | | | | |
|---|---|---|---|---|
| 2,218,941 | A | | 10/1940 | Thompson |
| 3,982,785 | A | | 9/1976 | Ambasz |
| 4,386,805 | A | | 6/1983 | Boisset |
| 4,408,800 | A | | 10/1983 | Knapp |
| 4,509,793 | A | | 4/1985 | Wiesmann et al. |
| 4,715,655 | A | | 12/1987 | Katsumoto et al. |
| 4,763,950 | A | * | 8/1988 | Tobler ..... 297/300.3 |
| 4,818,019 | A | * | 4/1989 | Mrotz, III ..... 297/303 |
| 4,938,532 | A | | 7/1990 | Burgess |
| 5,026,117 | A | * | 6/1991 | Faiks et al. ..... 297/300.5 |
| 5,029,822 | A | | 7/1991 | Selzer |
| 5,046,780 | A | | 9/1991 | Decker et al. |
| 5,074,620 | A | | 12/1991 | Jay et al. |
| 5,390,978 | A | | 2/1995 | Janisch |
| 5,556,163 | A | | 9/1996 | Rogers, III et al. |
| 5,575,534 | A | | 11/1996 | Yu |
| 5,762,399 | A | * | 6/1998 | Liu ..... 297/302.7 |
| 5,820,218 | A | | 10/1998 | Baloche et al. |
| 5,836,648 | A | | 11/1998 | Karschin et al. |
| 6,102,477 | A | | 8/2000 | Kurtz |
| 6,135,556 | A | | 10/2000 | Chu et al. |
| 6,193,314 | B1 | | 2/2001 | Chiang |
| 6,439,661 | B1 | * | 8/2002 | Brauning ..... 297/300.2 |

* cited by examiner

*Primary Examiner*—Peter M. Cuomo
*Assistant Examiner*—Stephanie Harris
(74) *Attorney, Agent, or Firm*—Jones Day

(57) ABSTRACT

A chair back upright tilts about a pivot axis with respect to a chair seat plate and has a protrusion on the bottom portion thereof. When the occupant of a chair reclines, the protrusion on the back upright and a stop plate make contact with each other. The contact stops the tilting of the back upright. A lever handle, fixedly attached to the stop plate, can be rotated thereby providing more or less tilting of the back upright before contact between the protrusion and the stop plate occurs.

7 Claims, 3 Drawing Sheets

MULTI-POSITION TILT-LIMITING MECHANISM

BACKGROUND OF THE INVENTION

1. Field of the Invention

The present invention relates in general to a chair in which the back upright portion is pivotable relative to the seat and, in particular, to a mechanism that provides a multi-position tilt limit adjustment for the back upright.

2. Description of Related Art Including Information Disclosed Under 37 C.F.R. §§1.97 and 1.98

There are many chairs, particularly for use in offices, but not limited thereto, that have a back rest that is pivotable relative to the chair seat or the chair base to allow the user to select an angle at which the seat is most comfortable for him or her. One such tilt-limiting mechanism is discussed in U.S. Pat. No. 6,102,477 that has a complex mechanism for making the adjustment to the tilt angle of the bank rest.

Further, U.S. Pat. No. 4,408,800 discloses an office chair that has a pneumatic cylinder operated by a cam that can adjust the attitude of the back rest over a continuous range about a pivot. U.S. Pat. No. 4,509,793 discloses a chair in which the inclination of the back rest portion and the seat portion can be varied.

Finally, in German Patent No. 2,218,941, an adjustable chair back is disclosed in which a back rest holding bracket has an extension that projects toward the center under the seat. The back rest angle is determined by locking the end of the extension against a lock plate in the desired position. The extension has a plate with a series of indentations formed in an essentially arcuate manner that engages a spring-loaded arm to hold the back rest in one of a plurality of positions.

Each of these patented devices is complex and complicated. It would be desirable to have a simple, tilt-limiting mechanism that enables multi-tilt positions of the seat back to be achieved.

SUMMARY OF THE INVENTION

The present invention achieves the desired goal of providing a simple multi-tilt limiting mechanism for a chair back upright with the use of an engaging member affixed to the lower end of the back upright and a stop rotatively affixed to the bottom side of the seat plate. The stop has an outer edge with a changing radius for interacting with the engaging member on the chair back such that rotation of the stop enables the back upright to be tilted forward and backward with respect to the seat plate. A lever handle is coupled to the stop to enable the user to rotate this stop and select the tilt position of the back upright from a minimum tilt to a maximum tilt.

In the preferred embodiment, a stepped surface forms the outer edge of the stop for interfacing with the engaging member on the lower end of the back upright. The engaging member may be in the form of a protrusion. The stepped surface has multiple steps such that each step, when engaging the protrusion, enables the back upright to assume the selected tilt position.

The tilt limiting mechanism further comprises a locking means for holding a stop in a selected rotatable position to provide a fixed tilt position of the back upright. To provide the locking means, a series of indexing detents is formed in the top side of the rotatable stop with each detent representing a selected upright tilt position. A biased plunger is mounted between the bottom side of the seat plate and the rotatable stop such that the plunger is engageable with any selected indexing indent to hold the stop in a selected rotated position. The indexing detents have a concave shape and are adjacent to each other and the plunger is in the form of a spring-loaded plunger so as to enable it to freely move from one concave detent to another while compressing the spring. When the plunger is in any selected detent, the spring urging the plunger in that the detent causes the stop to hold the seat back upright tilt in the selected position.

Thus, it is the object of the present invention to provide a multi-position tilt-limiting mechanism for a chair back upright.

It is another object of the present invention to provide a protrusion affixed to the lower end of the back upright for engaging a stop rotatively affixed to the bottom side of the chair seat plate.

It is another object of the present invention to provide an outer edge on this stop having a changing radius for engaging the protrusion so that rotation of the stop enables the back upright to be tilted forward and backward with respect to the seat plate.

It is another object of the present invention to provide a lever handle coupled to the stop to enable a user to rotate the stop and select a tilted position of the back upright from a minimum tilt to a maximum tilt.

It is yet another object of the present invention to provide a stepped surface forming the outer edge of the stop for engaging a protrusion at the lower end of the seat back upright, the stepped surface having multiple steps such that each step position for engaging the protrusion enables the back upright to assume a given tilted position.

It is also another object of the present invention to form the locking means with a series of indexing indents on the top side of the rotatable stop wherein each detent represents a selected back upright tilt position. A spring-loaded plunger is mounted between the bottom side of the seat plate and the rotatable stop such that the plunger engages any selected one of the detents to hold the stop in a selected rotated position to limit the back upright position to the selected tilt position.

Thus, the invention relates to a multi-position tilt-limiting mechanism for a chair back upright, the back upright having an upper end and a lower end, the chair having a seat plate with a top side and a bottom side and the back upright being tiltable with respect to the seat plate. The tilt-limiting mechanism comprises a protrusion affixed to the lower end of the back upright, a rotatable stop being affixed to the bottom side of the seat plate and having an outer edge with a changing radius for engaging a protrusion such that rotation of the stop enables the back upright to be tilted forward and backward with respect to the seat plate. A lever handle is coupled to the stop to enable a user to rotate the stop and select a tilt position from a minimum tilt to a maximum tilt.

The present invention is part of complete new chair construction as disclosed and claimed in U.S. application Ser. No. 09/882,237, entitled "Ergonomic Chair," filed on even date herewith, the complete disclosure of which is incorporated by reference herein.

BRIEF DESCRIPTION OF THE DRAWINGS

These and other objects of the present invention will be more fully described, and when taken in conjunction with the following detailed description of the drawings wherein like numerals represent like elements and wherein.

DETAILED DESCRIPTION OF THE PREFERRED EMBODIMENT(S)

Figure 1:
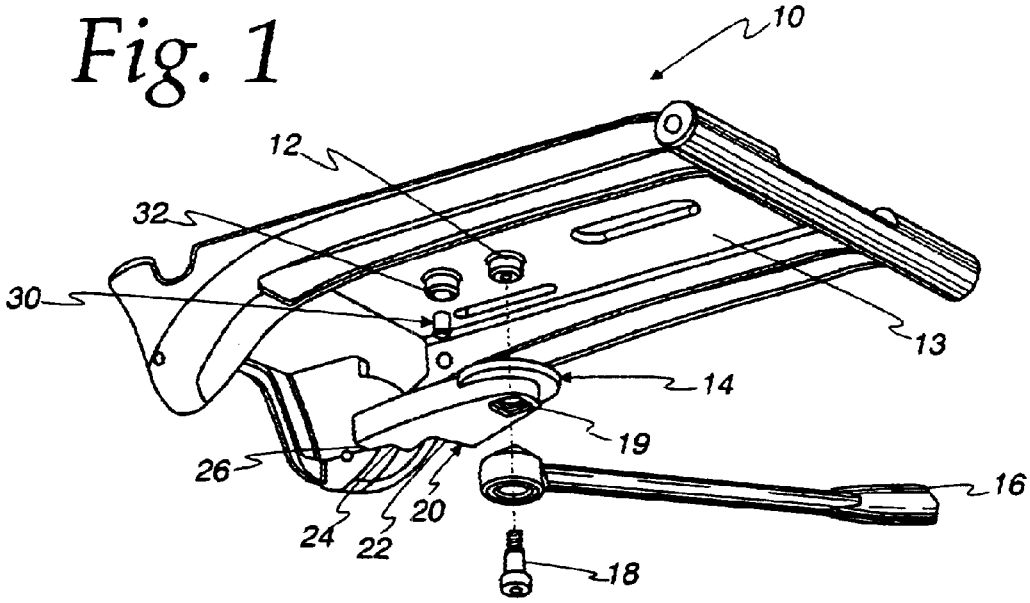
FIG. 1 is a perspective view of the bottom of the seat plate and illustrates the stop and its control mechanism in exploded form.

FIG. 1 is a bottom perspective view of the chair seat plate illustrating an exploded view of the stop, and its method of attachment to the bottom of the seat plate.

As can be seen in FIG. 1, a seat plate 10 has a mount 12 on a bottom side 13 to which a stop member or plate 14 and a lever handle 16 can be attached by a shoulder bolt 18 that is threadedly inserted into the mount 12 through an orifice 19 having an axis 21. The lever handle could be attached to the stop plate from either side of the chair.

It will be noted that the stop plate 14 has an outer edge 20, FIGS. 1 and 2, with a changing radius for interacting with an engaging member 28, FIG. 3, on the lower portion of the chair back upright frame as will be described in more detail in relation to FIG. 3. In the preferred embodiment, the engaging member 28 is in the form of a protrusion. The outer edge of the stop plate 14 has specific steps 22, 24 and 26, as can be best seen in FIG. 2, each having a different distance from the axis 21 with respect to the other. A retaining mechanism 30, in the form of a spring-biased plunger mounted in a bracket 32 on the bottom side 13, FIGS. 1 and 4, of the seat plate 10 and detents 34, 36, 38 in a top side 35 of the stop plate 14. The detents are shown in detail in FIG. 2. It will be noted that the outer edge 20 of the stop plate 14 may be a cam having an outer edge and a continuous radius. The number of detents may vary as desired, the number determining the number of chair back tilt positions.

Figure 2:
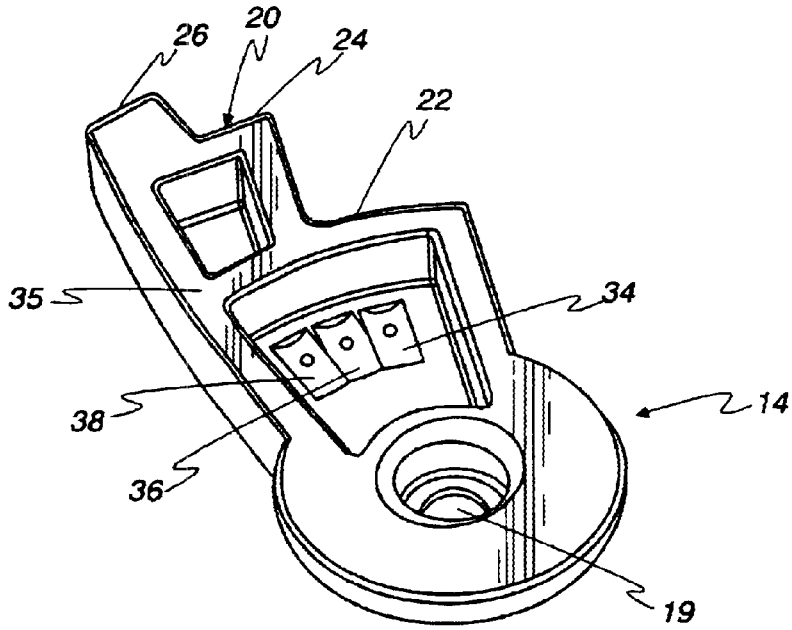
FIG. 2 is a top view of the stop illustrating the stepped outer edge representing a changing radius and also the indexing detents of the spring plunger.
Figure 5:
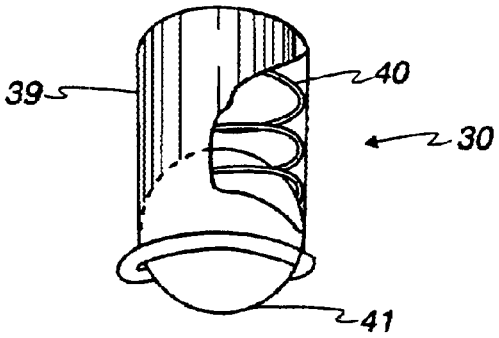
FIG. 5 is a partially broken-away isometric view of a plunger mechanism.

As can be seen in FIG. 2, there are the three indexing detents 34, 36 and 38 (for example only) in the top side 35 of stop plate 14. It will be noted that these indexing detents are of concave shape and are adjacent each other. Since the spring-loaded plunger is in the form of a spring-loaded ball, as can be best seen in FIGS. 1 and 5, the plunger is enabled to freely move in response to rotation of the stop plate 14 from one concave detent to another by compressing the spring. The plunger includes a container 39, a spring 40 mounted in the container and a ball 41 mounted adjacent the spring.

Figure 3:
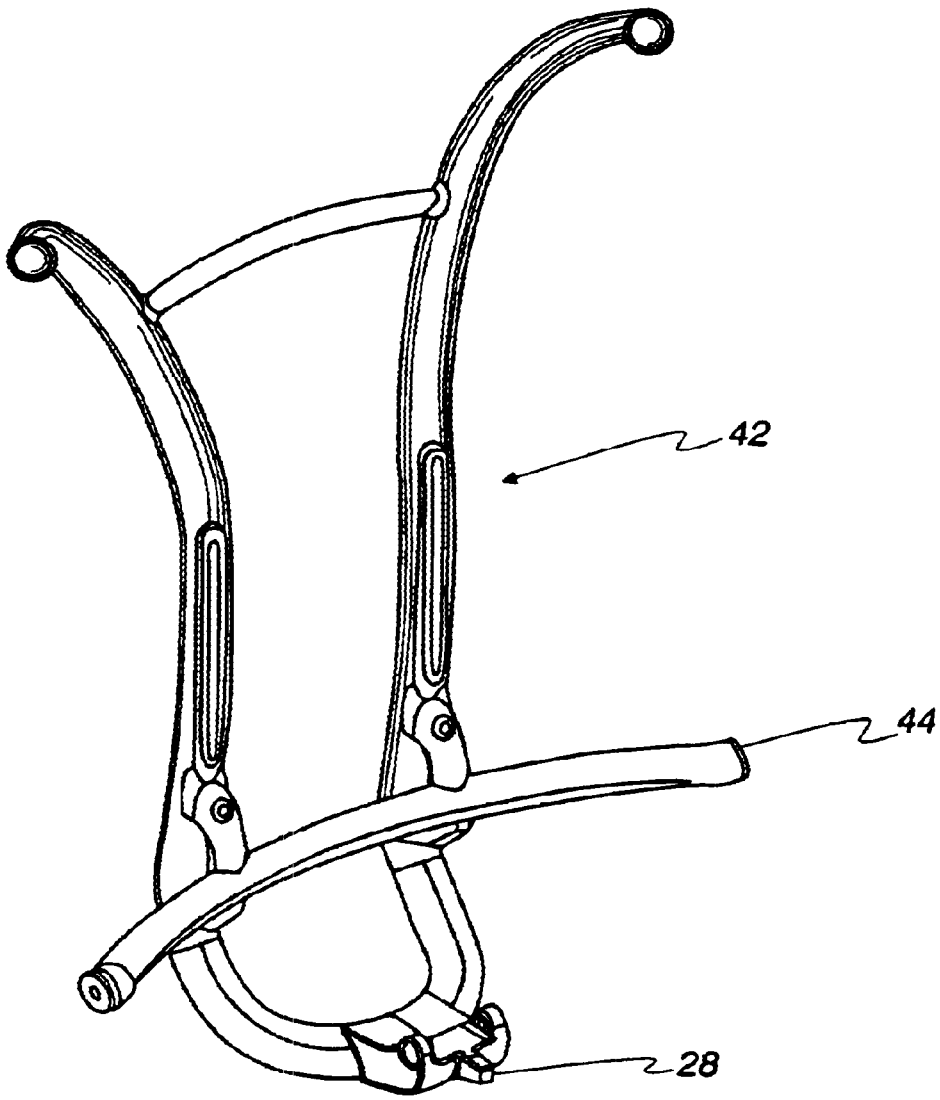
FIG. 3 is a perspective view of the back upright frame illustrating the engaging member at the bottom thereof.

The protrusion 28 can best be seen in FIG. 3. It is on the lower portion of the back upright frame 42. The back upright frame 42 rotates about a pivot axis 44. Since the protrusion 28 is below the pivot axis, as the top of the back frame 42 pivots about the axis 44 one way and the other, the protrusion 28 moves inwardly towards the stop plate and backwardly away from the stop plate thus allowing adjustment of the tilt mechanism by simply pivoting the lever handle 16.

Figure 4:
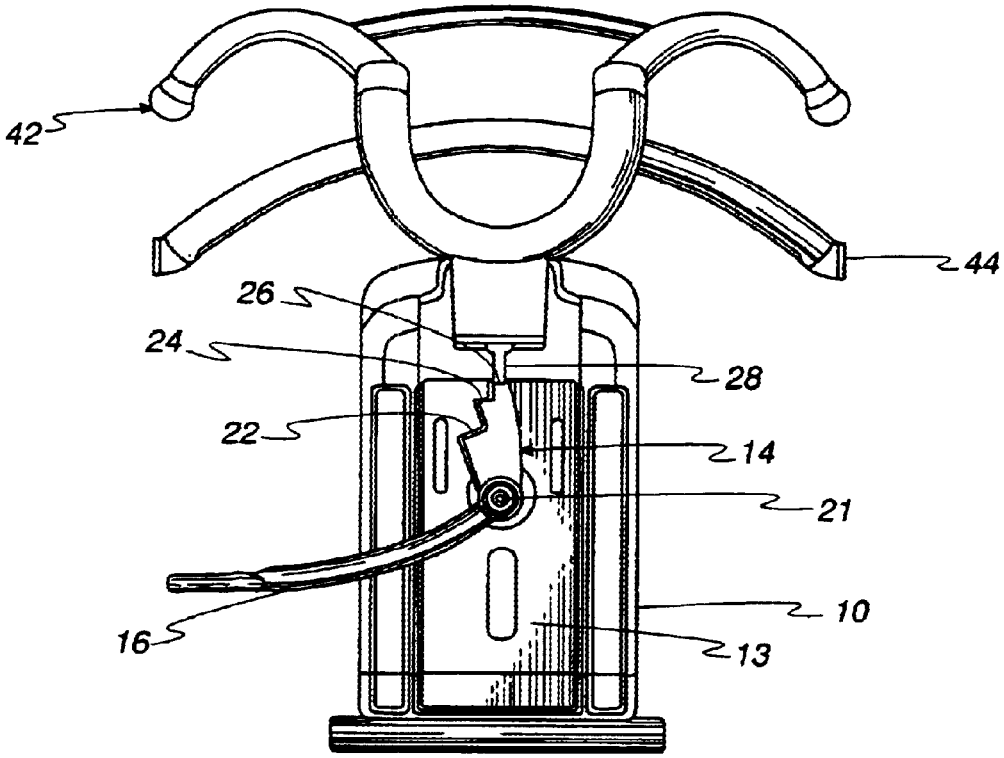
FIG. 4 is a bottom view of the seat plate and back upright illustrating the simplicity of the stop having the changing outer radius to engage the back upright engaging member and thus set the tilt limit of the chair back upright.

FIG. 4 is a bottom view of the seat plate 10 illustrating the stop plate 14, the lever handle 16 and the stepped surface 20 forming the outer edge of the stop plate 14 for engaging the protrusion 28 to change the tilt position of the back frame 42.

As can be clearly seen in FIG. 4, when the lever handle 16, fixedly attached to the stop plate 14, is moved on a horizontal plane, the stop plate 14 rotates about the axis 21, thus placing the various steps 22, 24 and 26 on the outer edge 20 in selective alignment and engagement with the protrusion 28 on the lower portion of the back frame 42 that pivots about the axis 44.

As stated earlier, it will be apparent to one skilled in the art that the outer edge 20 of stop plate 14 can be in a shape of a cam surface that has a continuously changing radius with respect to the axis 21 to cause different stop positions for the back frame upright 42 as the stop plate is rotated by the lever handle. In such case, the detents in the top side 35 of the stop plate 14 may be any number desired to achieve a desired range of minimum and maximum tilt of the back frame upright.

Thus there has been disclosed a novel and very simple tilt-limiting mechanism for the back frame of a chair simply by moving a stop plate 14 having an outer edge of changing radius for engaging a protrusion on the lower end of the chair back frame so that in a particular position of the stop plate, a particular tilt position of the back frame is selected from a minimum tilt to a maximum tilt.

While the present invention has been described as in connection with a preferred embodiment thereof, it will be apparent to those skilled in the art that many changes and modifications can be made without departing from the spirit and scope of the invention. Accordingly, it is intended by the appended claims to cover all such changes and modifications encompassed by the spirit and scope of the appended claims.

What is claimed is:

1. A multi-position tilt-limiting mechanism for a chair having a back upright, said back upright having an upper and a lower end, said chair having a seat plate with a top side and a bottom side, and said back upright being tiltable with respect to said seat plate, the tilt limiting mechanism comprising:

an engaging member affixed to the lower end of said back upright;

a stop member rotatably affixed to said seat plate and having an outer edge of different dimensions for interfacing with said engaging member such that rotation of said stop member enables said back upright to be tilted forward and backward with respect to said seat plate;

an operating member coupled to said stop member to enable a user to rotate said stop member and select the tape position of said back upright from a minimum tilt to a maximum tilt;

locking means for holding said stop member in a selected rotatable position, said locking means comprises a top side and a bottom side on said rotatable stop member, said top side facing said bottom side of said seat plate;

a series of indexing detents in said top side of said rotatable stop, each detent representing a selected back upright tilt position; and a biased plunger mounted between said bottom side of said seat plate and said detents such that said plunger engages any selected one of said detents to hold said stop plate in a selected rotated position.

2. The tilt-limiting mechanism of claim 1 wherein:

said indexing detents are of concave shape and are adjacent to each other; and said plunger is in a form of a spring-loaded ball so as to enable said ball to freely move from one concave detent to another by compressing said spring, said spring urging said plunger in any selected detent to cause said stop to hold said back upright in a selected tilt position.

3. A multi-position tilt-limiting mechanism for a chair comprising in combination:

a seat plate having a bottom surface;

a back frame pivotally connected to said seat plate and having a lower portion including an engagement member;

a stop member rotatably attached to said seat plate to move in a horizontal plane, said stop member having an edge surface with different positions at varying radii from an axis of rotation, said stop member has an upper surface facing said bottom surface of said seat plate;

a plurality of concave detent recesses formed in said upper surface for indexing said stop member;

a disengageable retaining element connected to the bottom surface of said seat plate for serially engaging said plurality of concave detent recesses; and an operating lever connected to said stop member for rotating said stop member.

4. The mechanism as claimed in claim 3 wherein:

said retaining element includes a biasing element that allows said retaining element to behave as a cam follower in response to a cam surface defined by said plurality of concave recesses; and said cam surface moves upon rotation of said operating lever by a chair user.

5. The mechanism as claimed in claim 4 wherein:

said engagement member is a protrusion; and said edge surface of varying radii includes steps.

6. The mechanism as claimed in claim 5 wherein:

said operating lever moves in an approximately horizontal plane.

7. A tilt limiting assembly comprising:

a horizontally disposed stop member directly attached to a seat plate and mounted to rotate about a vertical axis;

an elongated lever handle attached to said horizontally disposed stop member and disposed to rotate in a generally horizontal plane, said lever handle extending horizontally beyond said seat plate; and a back frame having an integral upper portion, a bottom protrusion and a pivot axis located between said upper portion and said bottom protrusion;

said horizontally disposed stop member having a plurality of abutment surfaces at different distances from said vertical axis; and said bottom protrusion of said back frame having an abutment surface for engaging selectively one of said plurality of abutment surfaces of said horizontally disposed structure stop member.

* * * * *